US006003538A

United States Patent [19]

Smith

[11] Patent Number: 6,003,538

[45] Date of Patent: Dec. 21, 1999

[54] DRAIN VALVE

[76] Inventor: Robert A. Smith, 4524 Bishop La., Louisville, Ky. 40218

[21] Appl. No.: 09/049,618

[22] Filed: Mar. 27, 1998

Related U.S. Application Data

[63] Continuation-in-part of application No. 09/007,984, Jan. 15, 1998.

[51] Int. Cl.[6] ..... F16K 17/38

[52] U.S. Cl. ..... 137/79; 137/62; 251/337; 267/158; 267/165; 267/167

[58] Field of Search ..... 137/62, 79; 251/337; 236/12.16, 12.17; 267/167, 158, 165, 120

[56] References Cited

U.S. PATENT DOCUMENTS

| | | | |
|---|---|---|---|
| 330,664 | 11/1885 | Bacon et al. . | |
| 1,293,604 | 2/1919 | Woolever . | |
| 4,243,062 | 1/1981 | Shelton . | |
| 4,345,234 | 8/1982 | Reich | 236/101 R |
| 4,437,481 | 3/1984 | Chamberlin et al. | 137/79 |
| 4,523,605 | 6/1985 | Ohkata . | |
| 4,809,727 | 3/1989 | Chamberlin . | |
| 5,007,622 | 4/1991 | Gabas | 267/158 |
| 5,024,426 | 6/1991 | Busch et al. | 267/158 |
| 5,464,198 | 11/1995 | Yanko et al. | 267/167 |
| 5,603,344 | 2/1997 | Hall, Jr. | 137/337 |
| 5,722,643 | 3/1998 | Chamberlin et al. | 267/120 |

*Primary Examiner*—A. Michael Chambers
*Assistant Examiner*—Thomas L. McShane
*Attorney, Agent, or Firm*—Middleton & Reutlinger; Charles G. Lamb; John F. Salazar

[57] ABSTRACT

A drain valve providing a drain sleeve having a first end, a second end and a flow-chamber therebetween. The first end includes a first diameter being smaller than a second diameter of the second end. The first diameter and the second diameter cooperate to define an annular shoulder therebetween. The first end is threadingly received by an air conditioner outlet and the drain sleeve has at least one drain hole therethrough near the shoulder for draining condensation from the air conditioner outlet. An outer cap is provided having an outer wall and an annular side wall projecting perpendicularly from an outer periphery of the end wall. The side wall is the outer cap is threadingly engageable with the drain sleeve second end. A sealing assembly is fixedly connected at a first end thereof to the end cap end wall and includes a second end thereof projecting inwardly from the end cap end wall towards the shoulder. The sealing assembly is moveable in response to changes in ambient temperature between a first position, wherein the sealing assembly second end is disposed in abutting relation to the shoulder, and a second position, wherein the sealing assembly second end is disposed outwardly of the shoulder. The sealing assembly includes a metal spring being substantially S-shaped.

4 Claims, 4 Drawing Sheets

DRAIN VALVE

CROSS-REFERENCE TO RELATED APPLICATIONS

The present invention is a continuation-in-part of, and claims priority from, my pending U.S. patent application Ser. No. 009/007,984, filed Jan. 15, 1998, entitled "Drain Valve", said Application being incorporated herein by reference.

BACKGROUND OF THE INVENTION

1. Technical Field of the Invention

The present invention relates to drain valves. More particularly, the present invention relates to a drain valve for use on a pressure trap outlet port of an air conditioner unit, wherein condensation is prevented from freezing therein.

2. Description of the Related Art

One function performed by air conditioning units used in many homes and businesses is to reduce the specific humidity of air located within the home or business. This process is typically accomplished by drawing the humid air into the air conditioning unit, removing moisture therefrom and blowing the less-humid air back into the home or business. The extracted moisture typically condenses within portions of the air conditioning unit, such as, for example, the pressure-trap outlet port, where it may freeze if subjected to a below-freezing surrounding temperature.

In the case of an air conditioner pressure-trap, the outlet port must be sealed during operation of the air conditioning unit to provide sufficient internal pressure drop to pump the air through the air conditioning unit. Whatever condensation which accumulates within the pressure-trap is not permitted to automatically drain therefrom. In the event the temperature of the air surrounding the pressure-trap drops below freezing, the condensation accumulated therein may freeze, thereby causing rupture or other damage thereto. Thus, it is desirable to provide a drain valve for use on an outlet end of an air conditioner pressure-trap, wherein the drain valve permits condensation to drain therefrom when the surrounding air temperature reaches a predetermined threshold value.

For example, U.S. Pat. No. 4,809,727 to Chamberlin teaches a thermally-activated drip valve for use on a standard outdoor faucet to prevent freezing of water therein, wherein a flow of water draining therethrough regulates opening and closing of the drip valve. However, it is further desirable to provide a drain valve wherein opening and closing thereof is activated in response to the temperature of the surrounding air and independently from the rate of flow of water or condensation therethrough.

SUMMARY OF THE INVENTION

The present invention is for a drain valve for use on an outlet port of an air conditioner pressure-trap, wherein the drain valve automatically opens and closes in response to the temperature of the surrounding air. The drain valve includes a rubber seal normally biased against the outlet port of the pressure-trap by a metal spring, thereby sealing same. However, the metal spring is constructed from a material which is designed to contract upon being exposed to a temperature less than 350 Fahrenheit, or approximately less than the freezing temperature of water at ambient pressure. The metal spring is fixedly mounted at an outer end thereof to an outer cap of the valve. Thus, as the metal spring contracts upon reaching a predetermined temperature, the rubber seal is withdrawn from the outlet port, thereby permitting the outlet port to be in fluid communication with an inner chamber of the valve outer cap. Condensation is thereby permitted to flow from within the outlet port of the pressure-trap, through the inner chamber of the valve outer cap, and to the surroundings by a plurality of drain holes provided in the valve outer cap. Once the ambient temperature rises above the activation temperature of the metal spring, the metal spring expands, returning the rubber seal to seat against the outlet port, thereby sealing same.

It is an object of the present invention to provide a drain valve for use on an outlet port of an air conditioner pressure-trap.

It is another object of the present invention to provide a drain valve for use on an outlet port of an air conditioner pressure-trap wherein condensation is prevented from freezing therein.

It is still another object of the present invention to provide a drain valve for use on an outlet end of an air conditioner pressure-trap, wherein the drain valve permits condensation to drain therefrom when the surrounding air temperature reach a predetermined threshold value.

It is yet another object of the present invention to provide a drain valve wherein opening and closing thereof is activated in response to the temperature of the surrounding air and independently from the rate of flow of water or condensation therethrough.

It is yet even a further object of the present invention to provide a drain valve for use on an outlet port of an air conditioner pressure-trap wherein the drain valve is constructed from low-cost, readily-available materials.

A drain valve providing a drain sleeve having a first end, a second end and a flow-chamber therebetween. The first end includes a first diameter being smaller than a second diameter of the second end. The first diameter and the second diameter cooperate to define an annular shoulder therebetween. The first end is threadingly received by an air conditioner outlet and the drain sleeve has at least one drain hole therethrough near the shoulder for draining condensation from the air conditioner outlet. An outer cap is provided having an outer wall and an annular side wall projecting perpendicularly from an outer periphery of the end wall. The side wall is the outer cap is threadingly engageable with the drain sleeve second end. A sealing assembly is fixedly connected at a first end thereof to the end cap end wall and includes a second end thereof projecting inwardly from the end cap end wall towards the shoulder. The sealing assembly is moveable in response to changes in ambient temperature between a first position, wherein the sealing assembly second end is disposed in abutting relation to the shoulder, and a second position, wherein the sealing assembly second end is disposed outwardly of the shoulder. The sealing assembly includes a metal spring being substantially S-shaped.

DESCRIPTION OF THE SEVERAL VIEWS OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENT

Figure 1:
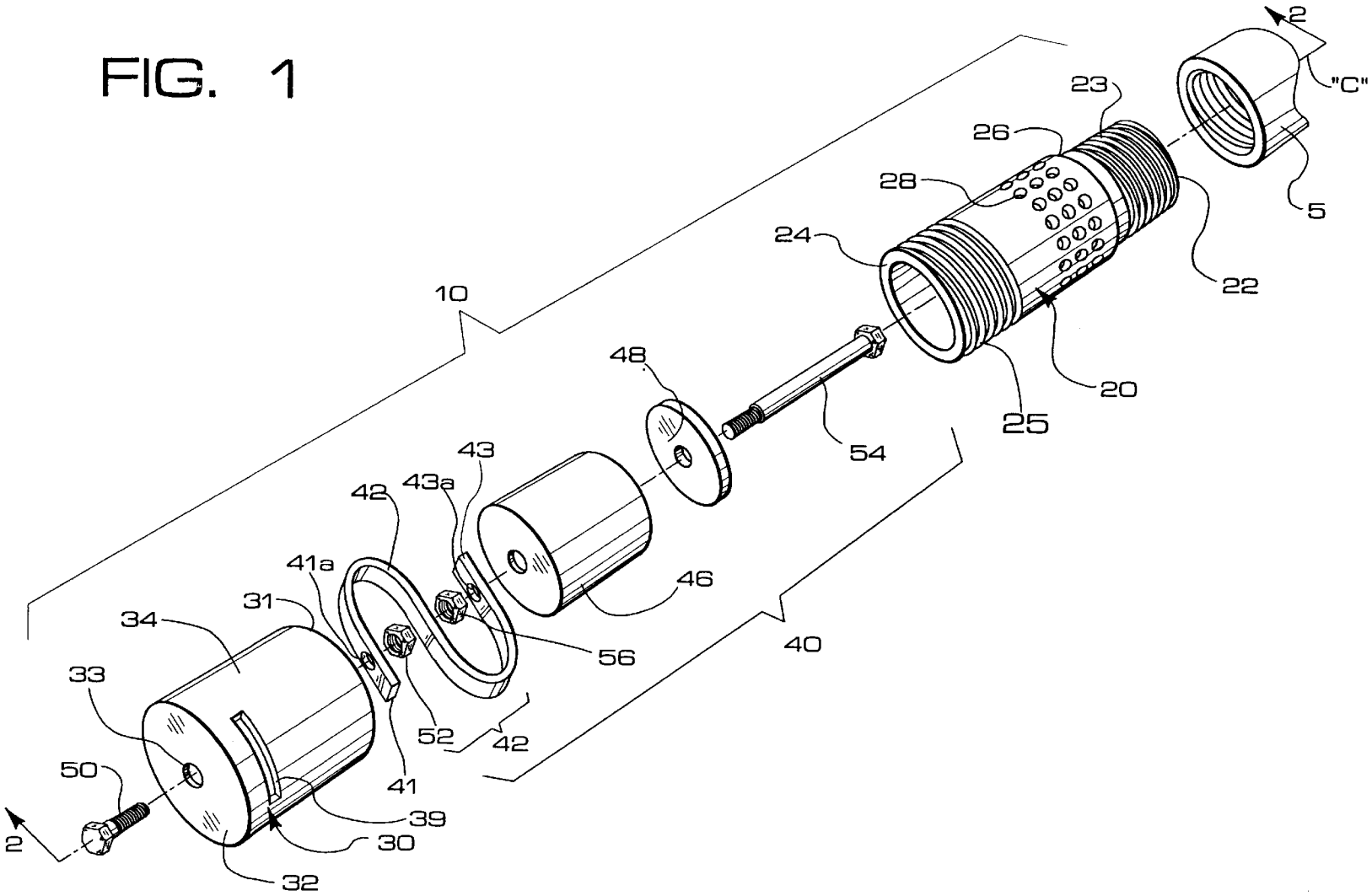
FIG. 1 is an exploded perspective view of a drain valve according to a preferred embodiment of the present invention shown in alignment with an outlet end of an existing air conditioner pressure-trap.
Figure 2:
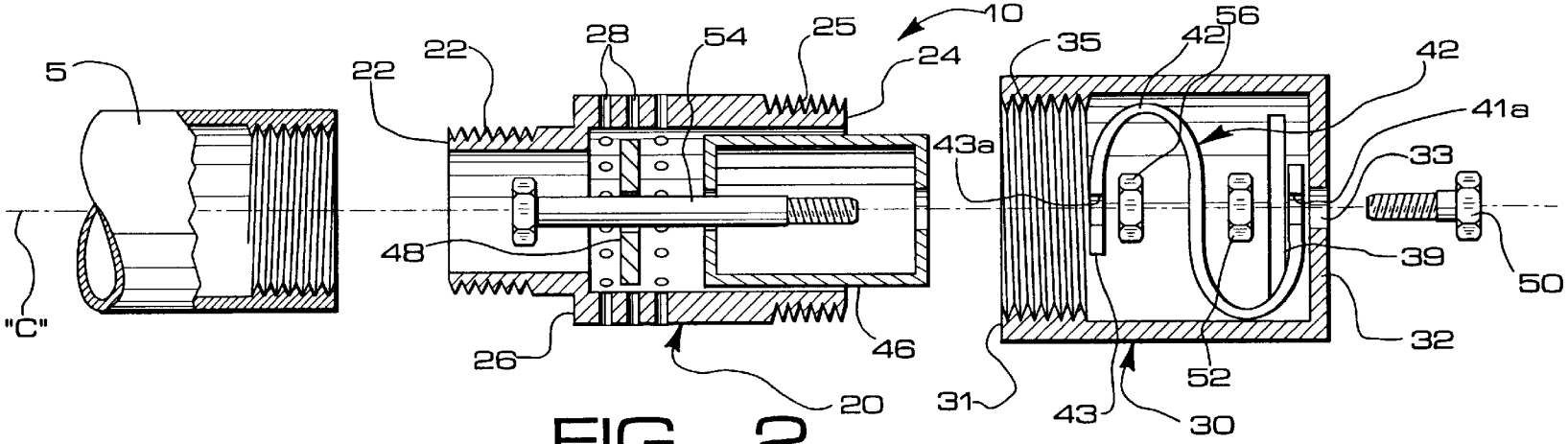
FIG. 2 is an exploded section view of the drain valve of FIG. 1, shown taken along section line 2—2 of FIG. 1.
Figure 3:
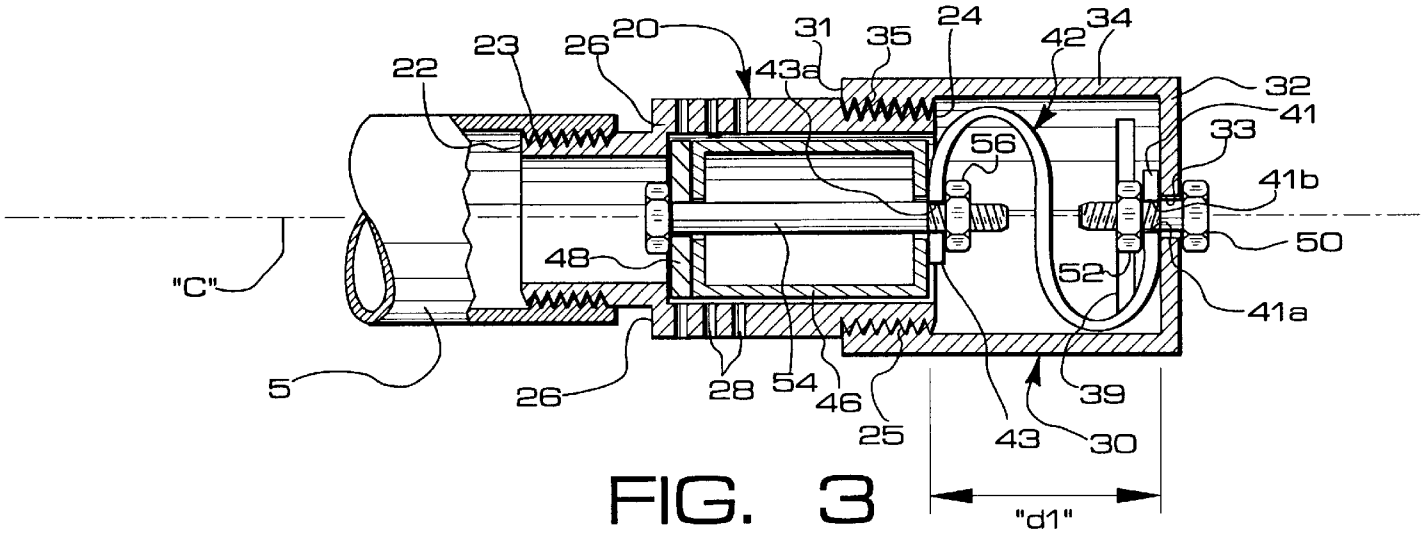
FIG. 3 is a section view of the drain valve of FIG. 1, shown taken along section line 2—2 of FIG. 1 and showing the drain valve in a "closed" position.

With reference to FIGS. 1–3, a drain valve 10 according to a preferred embodiment of the present invention includes a drain sleeve 20 including a first end 22 having a first diameter and a second end 24 having a second diameter. The second end diameter is greater than the first end diameter, thereby defining a shoulder 26 between the first and second ends 22, 24. The first end 22 includes an external thread 23 and is sized to be received by an internally-threaded outlet end 5 of an existing air conditioner pressure-trap (not shown). For example, the first end 22 may be sized to be received by a pressure-trap outlet end 5 having a ¾", 1", 1¼" or 2" standard threaded pipe fitting. The second end diameter is sized to be between approximately ½ and 1" greater than the first end diameter. The drain sleeve 20 may be of an integrally-molded construction, although it is preferably constructed from stock polyvinyl chloride ("PVC") tubing bonded, such as, for example, by applying thermal, glue or other adhesive means, together as shown in the Figures. Alternatively, the drain sleeve 20 may be constructed from any suitable material resistant to corrosion, such as, for example, stainless steel, plastic or the like.

A plurality of drain holes 28 are provided through the drain sleeve 20 near the shoulder 26 and are spaced equidistantly therearound, such as, for example, twelve (12) drain holes 28 being arcuately spaced every 30° around the drain sleeve 20 in a single circular row. Alternatively, drain holes 28 may be arcuately spaced and provided in a plurality of parallel rows. The drain holes 28 may be of any suitable size and shape to permit unrestricted draining of water or condensation therethrough.

An end cap 30 includes a circular end wall 32 and an annular side wall 34 depending perpendicularly from an outer periphery of the end wall 32. An internal thread 35 is provided on an inner surface of the side wall 34 towards a lower end 31 thereof and is sized to threadingly engage the external thread 25 provided on the second end 24 of the drain sleeve 20. A throughbore 33 is provided through the end wall 32, concentrically therewith, and is sized to slidingly receive a mounting bolt 50 therethrough. The end cap 30 may be of an integrally-molded construction, although it is preferably constructed from stock PVC tubing bonded, such as, for example, by applying thermal, glue or other adhesive means, together as shown in the Figures. Alternatively, the end cap 30 may be constructed from any suitable material being resistant to corrosion, such as, for example, stainless steel, plastic or the like.

A seal assembly 40 includes a metal spring 42 being fixedly mounted at a first end 41 thereof to the end cap end wall 32 by cooperation of the mounting bolt 50 with an engageable threaded nut 52 disposed inwardly therefrom. A plunger assembly is mounted to a second end 43 of the metal spring 42 by cooperation of a bolt 54 with an engageable threaded nut 56, and includes in series mounted, sliding relation therebetween a plunger 46 adjacent to the metal spring 42, and a seal 48 disposed inwardly therefrom. The plunger 46 and the seal 48 each include throughbores for slidingly receiving the bolt 54 therethrough. The plunger 46 may be of an integrally-molded construction, although it is preferably constructed from stock PVC tubing bonded, such as, for example, by applying thermal, glue or other adhesive means, together as shown in the Figures. The seal 48 is preferably constructed from rubber or other similar flexible, sealable, gasket material.

The metal spring 42 is preferably a one-piece construction and is substantially S-shaped, thereby defining the metal spring first and second ends 41, 43, respectively, spaced apart from one another by a first distance "$d_1$". Holes 41*a*, 43*a* are provided through the first and second ends 41, 43, respectively, of the metal spring 42 for slidingly receiving the mounting bolt 50 and the bolt 54, respectively, therethrough. The first and second ends 41, 43, respectively, of the metal spring 42 are oriented to position the holes 41*a*, 43*a* in coaxial alignment with one another along a center axis "C" of the drain valve 10. The metal spring 42 is sized to provide axial tensile force along the center axis "C" of the drain valve 10 between the outer cap 30 and the drain sleeve 20 when the drain valve is in a "closed" position, thereby normally biasing the seal 48 against an inner annular surface of the shoulder 26 when the outer cap 30 is threadingly secured to the drain sleeve second end 24.

Figure 4:
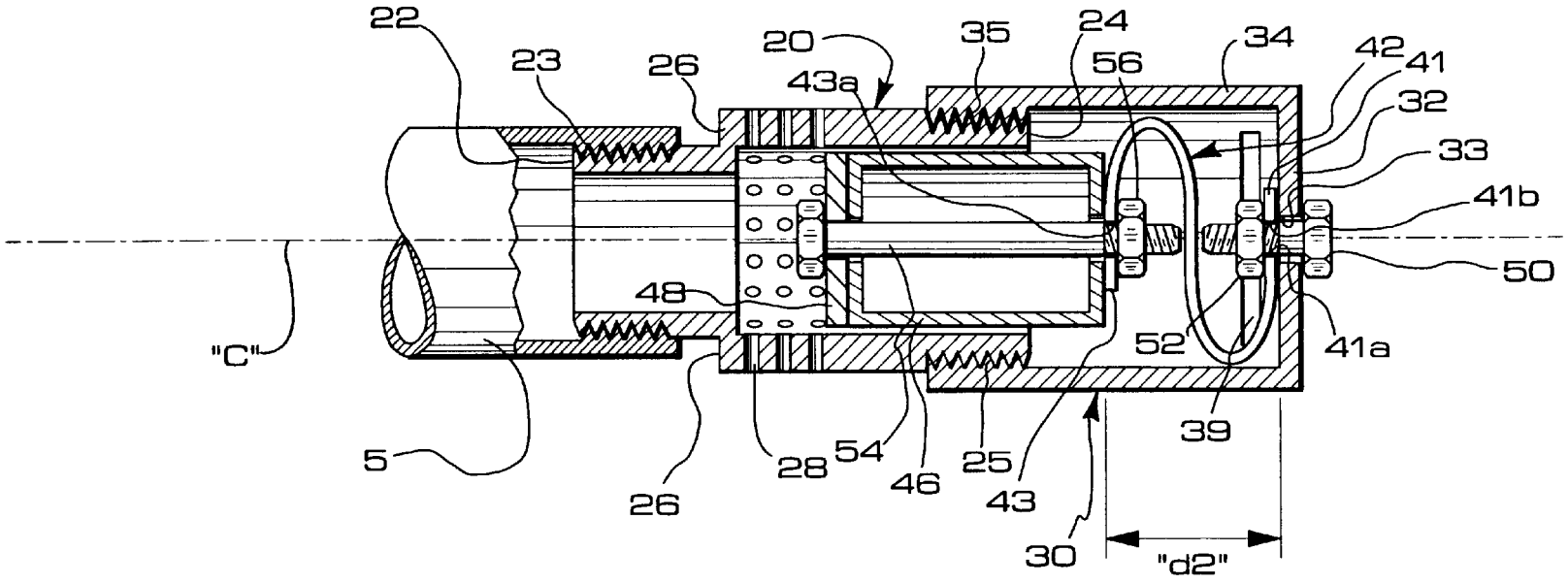
FIG. 4 is a section view of the drain valve of FIG. 1, shown taken along section line 2—2 of FIG. 1 and showing the drain valve in an "open" position; and, FIG. 5 is a section view of a drain valve according to an alternative embodiment of the present invention, shown taken along a longitudinal central axis thereof.

With additional reference to FIG. 4, the metal spring 42 is preferably constructed from a bi-metal material having thermal properties sufficient to permit the metal spring 42 to contract to an "open" position wherein the respective first and second ends 41, 43 of the spring 42 are spaced apart by a second distance "$d_2$", and wherein the second distance "$d_2$" is less than the first distance "$d_1$". The metal spring 42 is constructed from a material that will cause it to move into the "open" position upon reaching a threshold temperature of below approximately 350 Fahrenheit, such as, for example, a B1-type thermostat metal of the type manufactured by Texas Instruments under the trademark TRUFLEX. However, any material may be substituted in place thereof which has the property of increasing/decreasing its curvature and/or distance between distal ends in response to changes in temperature.

Because the first end 41 of the metal spring 42 is fixedly mounted to the end wall 32 of the end cap 30, contraction of the metal spring 42 to the "open" position causes the plunger 46 and the seal 48 to move axially along the center axis "C" away from the annular inner surface of the shoulder 26 and towards the end cap 30, thereby defining a passageway 60 between the seal 48 and the shoulder 26 through which condensation is permitted to pass from the pressure-trap, through the drain sleeve first end 22, through the passageway 60, over the shoulder 26 and into a chamber 62 defined by the drain sleeve 20 between the shoulder 26 and the second end 24 thereof. The condensation is permitted to drain freely from the chamber 62 through the drain holes 28 under the influence of gravity and to the surroundings.

Once the temperature of the metal spring 42 rises above the threshold level, the thermal properties thereof cause the metal spring 42 to expand, thereby seating the seal 48 against the annular surface of the shoulder 26. At least one arcuate slot 39 may be provided through the side wall 34 of the end cap 30 towards the end wall 32 thereof to permit the metal spring 42 to be in direct communication with the surroundings, thereby permitting the metal spring 42 to respond more directly to changes in ambient temperature of the surroundings.

Alternatively, the metal spring 42 may have any desired shape, such as, for example, a U-shape, C-shape or the like, which permits the desired change in distance between distal ends 41, 43 thereof upon a change in ambient temperature.

Figure 5:
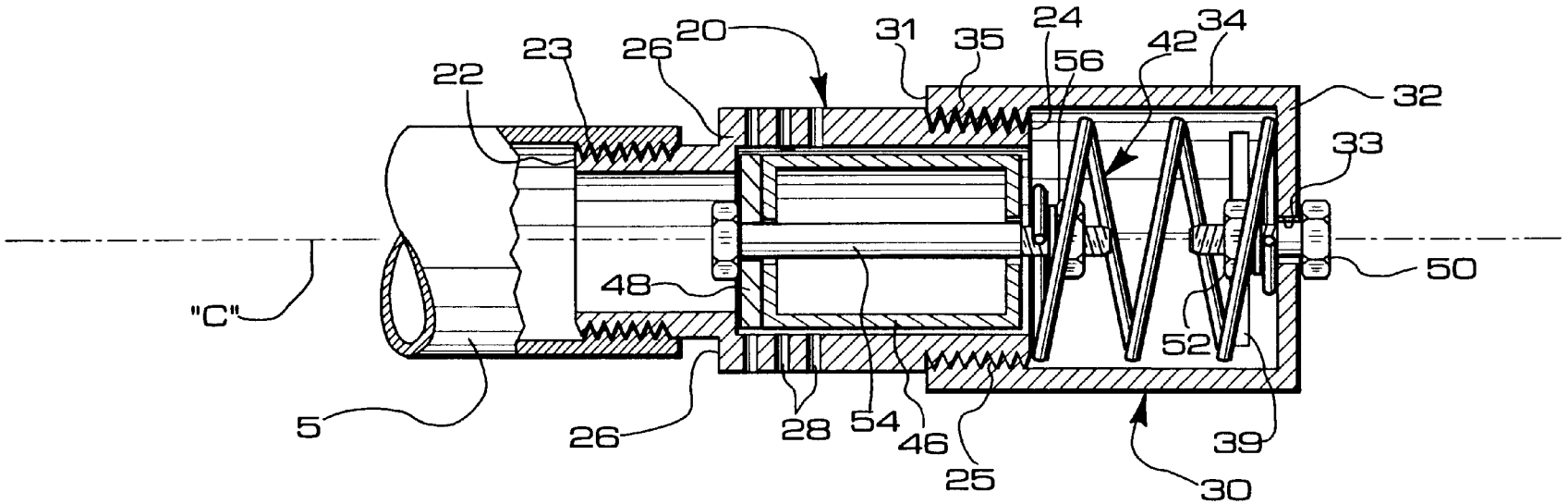

With reference to FIG. 5, a drain valve 110 according to an alternative embodiment of the present invention includes many components in common with a drain valve 10 according to the preferred embodiment hereof hereinabove described, and like reference numerals are intended to represent like components. However, the drain valve 110 according to the present embodiment includes a bi-metal spring 142 having a substantially cylindrical helical shape. Alternatively, the metal spring 142 may have any desired shape, such as, for example, a conical helical shape or the like, which permits the desired change in distance between distal ends thereof upon a change in temperature as hereinabove described.

Although the present invention has been described in terms of specific embodiments which are set forth in detail, it should be understood that this is by illustration only and that the present invention is not necessarily limited thereto, since alternative embodiments not described in detail herein will become apparent to those skilled in the art in view of the disclosure. Accordingly, modifications are contemplated which can be made without departing from either the spirit or the scope of the present invention as described hereinabove.

I claim:

1. A drain valve, comprising:

a drain sleeve having a first end, a second end and a flow-chamber therebetween, said first end having a first diameter, said second end having a second diameter, said second diameter being greater than said first diameter, said first diameter and said second diameter cooperating to define an annular shoulder therebetween, said first end being threadingly received by said air conditioner outlet, said drain sleeve having at least one drain hole therethrough near said shoulder;

an outer cap having an end wall and an annular side wall projecting perpendicularly from an outer periphery of said end wall, said side wall having a lower end thereof being threadingly engageable with said drain sleeve second end;

a sealing assembly fixedly connected at a first end thereof to said outer cap end wall and having a second end thereof projecting inwardly from said outer cap end wall towards said shoulder, said sealing assembly being moveable between a first position, wherein said sealing assembly second end is disposed in abutting relation with the inner surface of said shoulder, and a second position, wherein said sealing assembly second end is spaced from the inner surface of said shoulder;

said sealing assembly including a metal spring having a first end defining said sealing assembly first end and a second end disposed inwardly of said metal spring first end, a plunger having a first end fixedly connected to said metal spring second end and a second end disposed inwardly of said plunger first end, said plunger being integrally moveable with said metal spring second end, and, a seal fixedly connected to said plunger second end, said seal defining said sealing assembly second end, said seal being integrally moveable with said plunger; and, said metal spring being substantially S-shaped.

2. The drain valve of claim 1, wherein:

said sealing assembly is moveable between said first position and said second position in response to temperature changes therein.

3. The drain valve of claim 2, wherein:

said sealing assembly is disposed in said first position when said sealing assembly is above approximately 35° Fahrenheit; and, said sealing assembly is disposed in said second position when said sealing assembly is below approximately 35° Fahrenheit.

4. The drain valve of claim 1, further comprising:

at least one arcuate slot through said side wall of said outer cap.

* * * * *